US005699595A

United States Patent [19]

Feyerl

[11] Patent Number: 5,699,595

[45] Date of Patent: Dec. 23, 1997

[54] APPARATUS FOR NEEDLING A FIBROUS WEB

[75] Inventor: Günther Feyerl, Linz, Austria

[73] Assignee: Textilmaschinenfabrik Dr. Ernst Fehrer Aktiengesellschaft, Leonding, Austria

[21] Appl. No.: 733,023

[22] Filed: Oct. 16, 1996

[30] Foreign Application Priority Data

Oct. 18, 1995 [AT] Austria ..... A 1731/95

[51] Int. Cl.[6] ..... D04H 18/00

[52] U.S. Cl. ..... 28/107; 28/114; 28/111

[58] Field of Search ..... 28/107, 108, 109, 28/110, 112, 111, 113, 114

[56] References Cited

U.S. PATENT DOCUMENTS 5,287,604 2/1994 Feyerl ..... 28/107 X

*Primary Examiner*—John J. Calvert

*Attorney, Agent, or Firm*—Collard & Roe, P.C.

[57] ABSTRACT

An apparatus for needling a fibrous web comprises a row of needle beams arrayed adjacently each other in a direction of an operating width. The needle beams may be attached to exchangeable needle boards and are driven with the needle boards up and down in a reciprocating motion path. The fibrous web is guided by a fibrous web support and a stripper positioned between the needle beams and the support. A conveyor conveys the exchangeable needle boards to and from the needle beams. The conveyor device extends alongside the row of needle beams and comprises revolving endless traction devices arranged at each side of the needle beams outside the reciprocating motion path, and needle board entrainment elements in the form of bearing flanges for supporting side edges of the needle boards. The bearing flanges are carried by the traction devices and are repositionable between a conveying position wherein they project into the reciprocating motion path and an inoperative position wherein they are outside the reciprocating motion path of the needle boards attached to the needle beams.

6 Claims, 3 Drawing Sheets

APPARATUS FOR NEEDLING A FIBROUS WEB

BACKGROUND OF THE INVENTION

1. Field of the Invention

The present invention relates to an apparatus for needling a fibrous web, which comprises a row of needle beams arrayed adjacently each other in a direction of an operating width, the needle beams being adapted to be connected to exchangeable needle boards, means for driving the needle beams with the needle boards up and down in a reciprocating motion path, guidance means for the fibrous web, the guidance means comprising a fibrous web support and a stripper positioned between the needle beams and the support, and a conveyor device for conveying the exchangeable needle boards to and from the needle beams, the conveyor device extending alongside the row of needle beams.

2. Description of the Prior Art

To compensate for the stresses on the needle beams due to their vertical reciprocating motion, it has been proposed to provide a row of needle beams arrayed with their needle boards adjacent each other in a direction of an operating width if the operating width is relatively large. However, this division into a number of adjacent needle beams makes an exchange of the needle boards more difficult when the needle boards are either worn out or damaged, or when it is desired to use needle boards with a different needle distribution or configuration. Such an exchange requires the needle boards to be conveyed along the row of needle beams to be removed from the needle beams after they have been detached therefrom or to be brought into alignment with the needle beams for connection thereto. For this purpose, it is known to mount a guide for assembly carriages alongside the stripper, the assembly carriages comprising a receiving trough for the needle boards so that the needle boards disposed on the receiving trough may be lifted off the assembly carriages by the needle beams after they have been connected thereto, and the assembly carriages may be guided out of the range of the needle beams. Such a needle board conveyance with assembly carriages is not only structurally complicated but also requires relatively long down times because the assembly carriages must be retracted from the apparatus after new needle boards have been inserted to prevent serious damage to the apparatus

SUMMARY OF THE INVENTION

It is the primary object of this invention to improve a needling apparatus of the first-described type in such a manner that the exchange of the needle boards is substantially facilitated with a relatively simple structure.

The above and other objects are accomplished according to the invention with a conveyor device which comprises revolving endless traction means arranged at each side of the needle beams outside the reciprocating motion path of the needle beams with the needle boards, and needle board entrainment elements in the form of bearing flanges for supporting side edges of the needle boards, the bearing flanges being carried by the traction means and being repositionable between a conveying position wherein they project into the reciprocating motion path and an inoperative position wherein they are outside the reciprocating motion path of the needle boards connected to the needle beams.

In such an endless conveyor device, the needle boards only need to be disposed on the bearing flanges for entrainment by the traction means to the needle beams so that they may be lifted off the bearing flanges by the needle beams after they have been attached thereto. A return of assembly carriages or the like is avoided. The only thing required is to make sure that the bearing flanges are repositioned outside the reciprocating motion path during needling when the needle beams and attached needle boards move up and down.

According to a preferred embodiment providing a particularly simple structure, the revolving endless traction means is comprised of an upper conveying strand and a lower return strand. This very much simplifies the conveyance of the needle boards to the revolving traction means since the needle boards only need to be pushed onto the traction means. Furthermore, the bearing flanges may be distributed over only a portion, for example over half, of the circumference of the revolving traction means. In this way, the mere continuing revolution of the traction means will move the bearing flanges from the conveying strand to the return strand and thus out of the reciprocating motion path of the needle beams with the attached needle boards. No further means are required for this.

It would also be possible, however, to mount the bearing flanges pivotally on the traction means for repositioning the bearing flanges between the conveying and inoperative positions. The pivoting motion may be cam-controlled. Such a structural arrangement is more complicated but has the advantage that the revolving traction means does not have to be driven over half of its revolving path after the needle boards have been assembled with the needle beams. Pivoting the bearing flanges by cams which are stationary relative to the revolving traction means provides a simple automatic control of the bearing flange movements and makes incorrect movements of the bearing flanges impossible.

The provision of the endless conveying device of the present invention also offers the possibility for a simple cleaning of the stripper, as well as the needle boards, within the apparatus. For this purpose, the revolving traction means may serve as a carrier for a detachable cleaning device. Such a cleaning device may be comprised of cleaning brushes or compressed air nozzles which are attached to the revolving traction means when it is desired to clean the stripper or the needle boards, which are in their raised position during such cleaning.

BRIEF DESCRIPTION OF THE DRAWING

The above and other objects, advantages and features of this invention will be described in detail in connection with a now preferred embodiment illustrated in the accompanying schematic drawing wherein.

DETAILED DESCRIPTION OF THE PREFERRED EMBODIMENT

Figure 1:
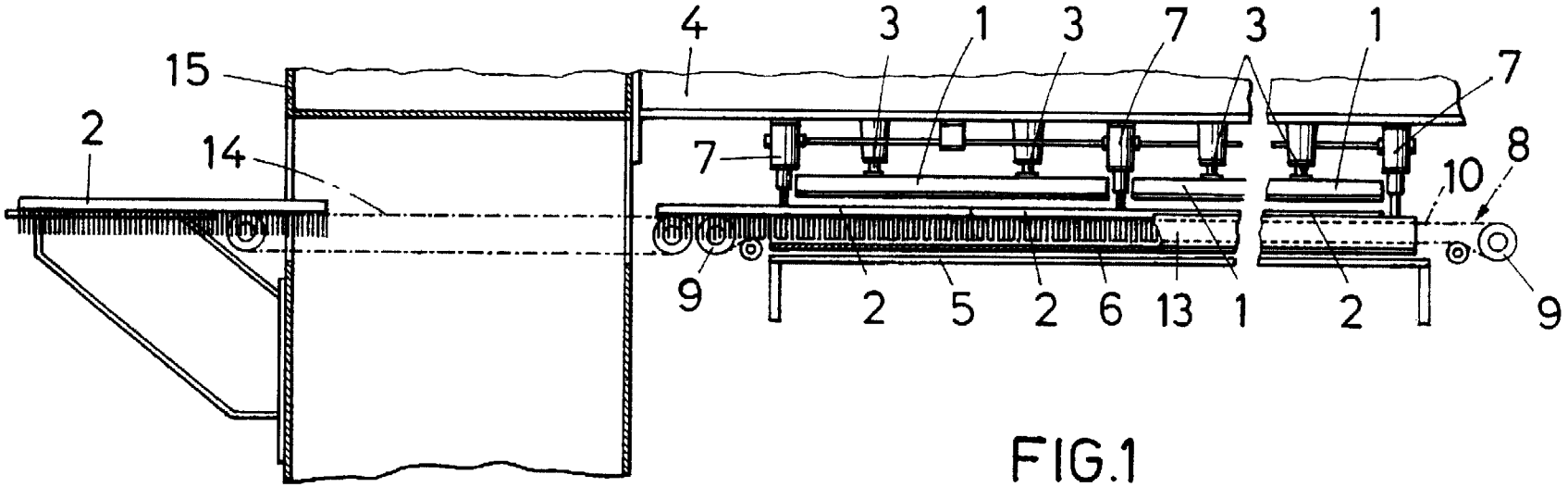
FIG. 1 is a fragmentary end view, partly in transverse section, of a needling apparatus according to the invention.

Referring now to the drawing and first to FIG. 1, there is shown an apparatus for needling a fibrous web, which comprises a row of needle beams 1 arrayed adjacent each other in a direction of an operating width. The needle beams are adapted to be attached to exchangeable needle boards 2 by conventional screw or clamping elements which may be operated automatically. To drive needle beams 1 with needle boards 2 up and down in a reciprocating motion path, the needle beams are connected to push rods 3 driven by a reciprocating drive in any conventional manner. Usually, the reciprocating drive is a crank drive, and a separate drive box associated with each needle beam is affixed to a carrier 4 which extends over the entire operating width. A guidance means for the fibrous web comprises fibrous web support 5 and stripper 6 positioned between needle beams 2 and support 5. The support and the stripper are perforated plates through whose holes the needles pass during needling. Drives 7 are connected to carriers 13 of stripper 6 and may be actuated in unison for vertical adjustment of the stripper.

To exchange individual needle boards 2, a conveyor device 8 for conveying the exchangeable needle boards to and from needle beams 1 extends alongside the row of needle beams. According to the invention, this conveyor device comprises revolving endless traction means 10 arranged at each side of needle beams 1 outside the reciprocating motion path, and needle board entrainment elements 11 in the form of bearing flanges for supporting side edges of needle boards 2. The bearing flanges are carried by traction means 10 and are repositionable between a conveying position wherein they project into the reciprocating motion path (FIG. 2) and an inoperative position wherein they are outside the reciprocating motion path of needle boards 2 attached to needle beams 1. The revolving endless traction means at each side of needle beams 1 are preferably sprocket chains.

Figure 3:
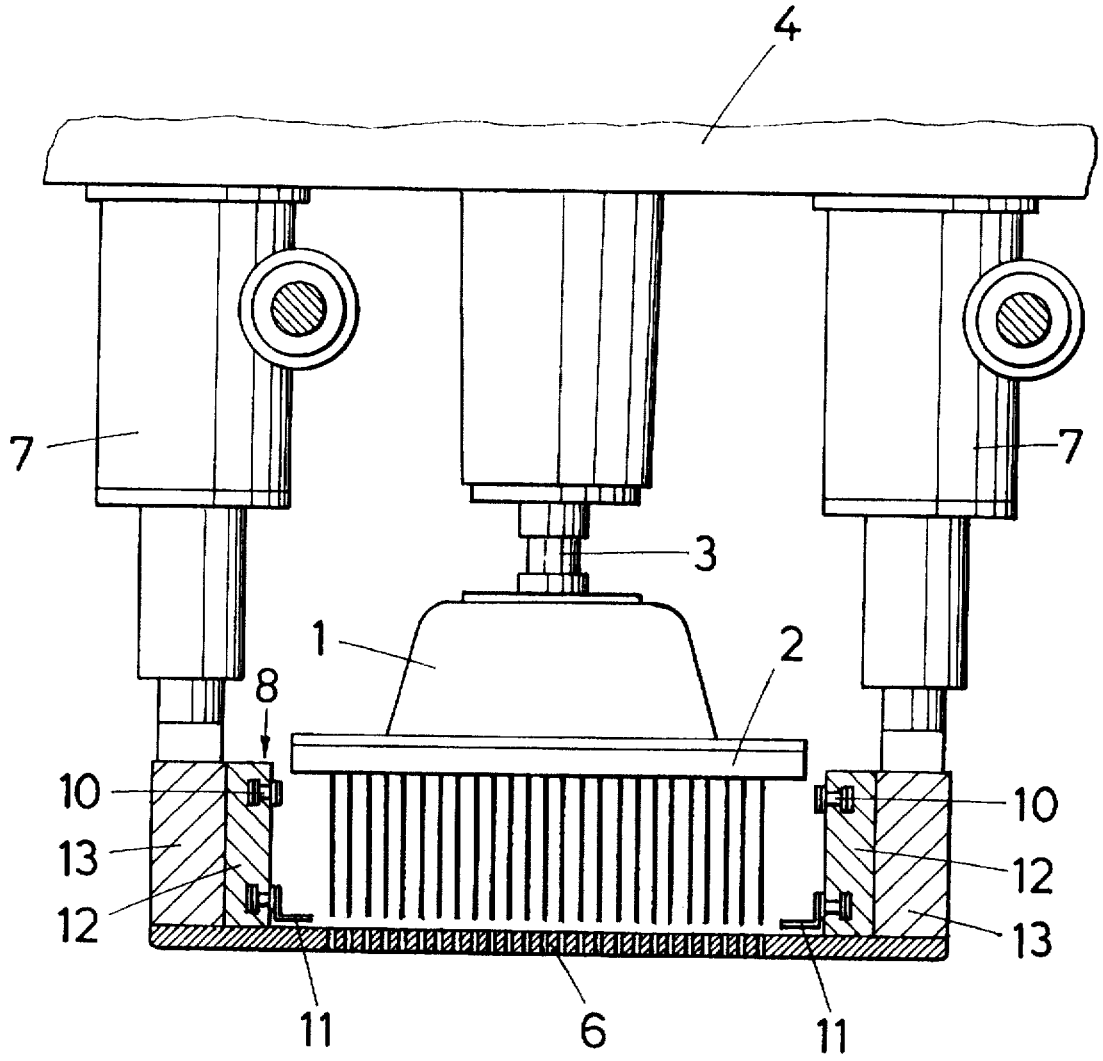
FIG. 3 is a corresponding view of the apparatus during needling when the bearing flanges are in the inoperative position.

The chains trained about sprockets 9 run in guides 12 and are comprised of an upper conveying strand and a lower return strand. The bearing flanges are distributed over only a portion of the circumference of revolving traction means 10, and in the illustrated embodiment, the bearing flanges are distributed over half the circumference of the revolving traction means. In this manner, half a revolution of the chain will move bearing flanges 11 from the upper conveying strand to the lower return strand, i.e. out of the reciprocating motion path of needle beams 1 with attached needle boards 2 during needling, as indicated in FIG. 3. For this purpose chain guides 12 are connected just above stripper 6 with carriers 13 of the stripper.

Figure 2:
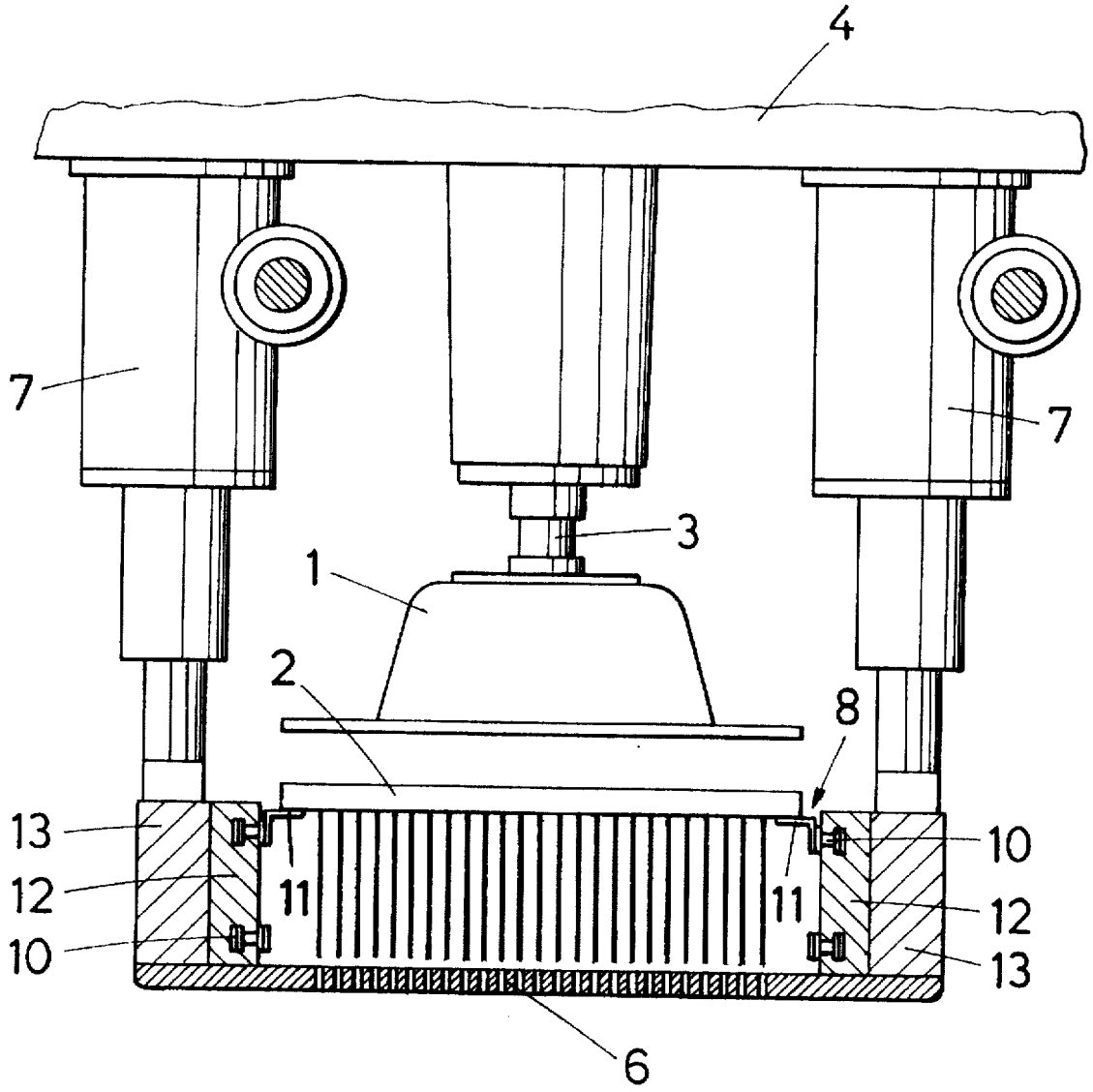
FIG. 2 is an enlarged fragmentary sectional view of the apparatus, along line II—II of FIG. 1, during an exchange of the needle boards.

In operation, new needle boards 2 are conveyed through a gantry frame 14 at a side of the apparatus to the needling apparatus by a conveyor 14, which may be of a similar structure as conveyor device 10. An input end of revolving endless traction means 8 adjoins an output end of conveyor 14 so that the needle board on conveyor 14 is transferred to conveyor device 10 where it rests on entrainment elements 11 to be conveyed underneath raised needle beams 1 (FIG. 2). After stripper 6 and traction means 8 are raised by drives 7, needle boards 2 may be attached to needle beams 1 in any conventional manner, for example by screws or clamps. Stripper 6 is then lowered by drives 7 to lift the needle boards off entrainment elements 11 and traction means 8 is revolved by half a revolution to reposition the entrainment elements in the return strand (FIG. 3). In this position, entrainment elements 11 are outside the reciprocating motion path of needle board 2 during needling. The needle boards are removed from the needling apparatus by reversing the procedure.

The needle boards may be manually placed on, and removed from, conveyor 14 during an exchange or a needle board storage magazine may be provided adjacent conveyor 14 to deliver and receive the needle boards.

What is claimed is:

1. An apparatus for needling a fibrous web, which comprises (a) a row of needle beams arrayed adjacently each other in a direction of an operating width, the needle beams being adapted to be attachable to exchangeable needle boards, (b) means for driving the needle beams with the needle boards up and down in a reciprocating motion path, (c) guidance means for the fibrous web, the guidance means comprising (1) a fibrous web support and (2) a stripper positioned between the needle beams and the support, and (d) a conveyor device for conveying the exchangeable needle boards to and from the needle beams, the conveyor device extending alongside the row of needle beams and comprising (1) revolving endless traction means arranged at each side of the needle beams outside the reciprocating motion path, and (2) needle board entrainment elements in the form of bearing flanges for supporting side edges of the needle boards, the bearing flanges being carried by the traction means and being repositionable between a conveying position wherein the flanges project into the reciprocating motion path and an inoperative position wherein the flanges are outside the reciprocating motion path of the needle boards attached to the needle beams.

2. The needling apparatus of claim 1, wherein the revolving endless traction means is comprised of an upper conveying strand and a lower return strand.

3. The needling apparatus of claim 1, wherein the bearing flanges are distributed over only a portion of the circumference of the revolving traction means.

4. The needling apparatus of claim 3, wherein the bearing flanges are distributed over half the circumference of the revolving traction means.

5. The needling apparatus of claim 1, wherein the bearing flanges are pivotally mounted on the traction means for repositioning the bearing flanges between the conveying and inoperative positions under the control of cams.

6. The needling apparatus of claim 1, wherein the revolving traction means serves as a carrier for a detachable cleaning device.

* * * * *